US006856851B2

(12) United States Patent
Baitelli et al.

(10) Patent No.: US 6,856,851 B2
(45) Date of Patent: Feb. 15, 2005

(54) APPARATUS AND METHOD FOR OPERATING AND CONTROLLING A TEXTILE MACHINE

(75) Inventors: Gian Mario Baitelli, Palazzolo (IT); Claudio Locatelli, Palazzolo (IT)

(73) Assignee: Marzoli S.p.A., Palazzolo (IT)

( * ) Notice: Subject to any disclaimer, the term of this patent is extended or adjusted under 35 U.S.C. 154(b) by 0 days.

(21) Appl. No.: 10/691,605

(22) Filed: Oct. 24, 2003

(65) Prior Publication Data

US 2004/0093846 A1 May 20, 2004

(30) Foreign Application Priority Data

Oct. 25, 2002 (EP) ..... 02425641

(51) Int. Cl.[7] ..... G06F 19/00
(52) U.S. Cl. ..... 700/142; 57/264
(58) Field of Search ..... 700/142, 139; 19/240; 57/258, 260, 92, 93, 96, 315

(56) References Cited

U.S. PATENT DOCUMENTS 4,099,297 A * 7/1978 Hasegawa et al. ..... 19/240
4,569,192 A 2/1986 Yamada et al.
6,476,570 B1 * 11/2002 Pasini et al. ..... 57/92 X

FOREIGN PATENT DOCUMENTS

| | | |
|---|---|---|
| DE | 40 26 581 A1 | 3/1992 |
| EP | 0 777 167 A1 | 6/1997 |
| EP | 1 072 700 A1 | 1/2001 |
| JP | 62-170532 | 7/1987 |

OTHER PUBLICATIONS

European Search Report date Mar. 19, 2003 for European Application No. EP 02 42 5641.

* cited by examiner

*Primary Examiner*—Peter Nerbun
(74) *Attorney, Agent, or Firm*—Hogan & Hartson LLP

(57) ABSTRACT

An apparatus for operating and controlling a textile machine comprises driving means, an operating device, a control device and selection means, for the purpose of using the said textile machine for conventional weaving processes and/or for stubbing, multicount, multitwist and multicount-multitwist processes.

21 Claims, 4 Drawing Sheets

APPARATUS AND METHOD FOR OPERATING AND CONTROLLING A TEXTILE MACHINE

CROSS REFERENCE TO RELATED APPLICATIONS

This application claims priority from European Patent Application No. 02425641.4 filed Oct. 25, 2002, the disclosure of which is hereby incorporated by reference in its entirety.

STATEMENT REGARDING SPONSORED RESEARCH OR DEVELOPMENT

Not Applicable

REFERENCE TO SEQUENCE LISTING

Not Applicable

BACKGROUND OF THE INVENTION

1. Field of the Invention

The present invention relates to an apparatus for operating and controlling a textile machine designed to process a roving in order to form it into a yarn made from a continuous sequence of portions, each portion having predetermined count and/or twist characteristics.

2. Description of Related Art

In particular, the present invention relates to an operating and control apparatus designed to be associated particularly, but not solely, with a textile machine such as a ring spinning machine.

In the modern textile industry, there is an increasing trend towards the production of high-value textiles, frequently characterized by unusual aesthetic qualities which distinguish them from ordinary products.

In particular, it is known that the count or twist characteristics of a yarn can affect the aesthetic qualities of the textile made from the yarn.

The variation of the count of a yarn, in other words the variation of its nominal diameter along its length, gives rise to a thickening or thinning of the textile made from the yarn, giving it pleasing aesthetic qualities.

In this case, the yarn is called "slub yarn", and the corresponding process is called "slubbing". Alternatively, with certain differences taken into consideration, the yarn and the process are called "multicount".

Similarly, a variation in the twist of the yarn is related to its capacity to absorb colour. In this case also, if this characteristic is exploited skilfully, it is possible to produce textiles having unusual chromatic characteristics which, as is done increasingly frequently, make the textile into a high-value product. In this case, the process and the corresponding yarn are called "multitwist".

It is also possible to vary the count and the twist simultaneously. In this case, the process and the corresponding yarn are called "multicount-multitwist".

Generally, the yarn is processed in such a way that it acquires the desired count and/or twist characteristics in a ring spinning machine, by passing through specially designed drawing and twisting devices in which the count or the twist of the yarn is varied by suitably adjusting the speed of the drawing rollers or the spindles.

An example of a textile machine based on the aforesaid principle is described in GB-A-2034764.

There is also a known way of generating appropriate reference signals which, when suitably interpreted by dedicated devices of the textile machine, adjust the speed of the driving means in order to generate a yarn in which the variation of the count or of the twist corresponds to the values of a specified function.

An example of an embodiment as above is described in EP 669414.

However, it is frequently the case that processes designed to produce yarns having specific count and/or twist characteristics as specified above form only part of the actual production process of a textile business, most of whose output consists of basic yarns having specified count and/or twist characteristics throughout their length.

This makes it necessary to have machines of the conventional type and modern machines, capable of carrying out multicount, multitwist or multicount-multitwist processing, available simultaneously. Alternatively, if modem textile machines are used exclusively, the costs incurred by programming them in order to use them as conventional machines have to be met.

There is thus a requirement, which has not yet been met, for the use of modern textile machines in a simple and efficient way both for carrying out stubbing, multicount, multitwist or multicount-multitwist processes and for carrying out conventional spinning processes in which the count and twist remain constant along the length of the yarn which is produced.

SUMMARY OF THE INVENTION

The problem tackled by the present invention is that of devising an apparatus for operating and controlling a textile machine which has structural and functional characteristics such that the aforesaid requirements are met while the drawbacks mentioned with reference to the known art are overcome.

This problem is resolved by an operating and control apparatus according to Claim 1. Further variant embodiments of the apparatus according to the invention are described in the claims dependent on Claim 1. Finally, this problem is resolved by a method for processing a roving according to Claim 19. Further variants of this method are described in the claims dependent on Claim 19.

Further characteristics and the advantages of the apparatus and method according to the invention are made clear by the following description.

DETAILED DESCRIPTION OF THE PREFERRED EMBODIMENTS

Figure 1:
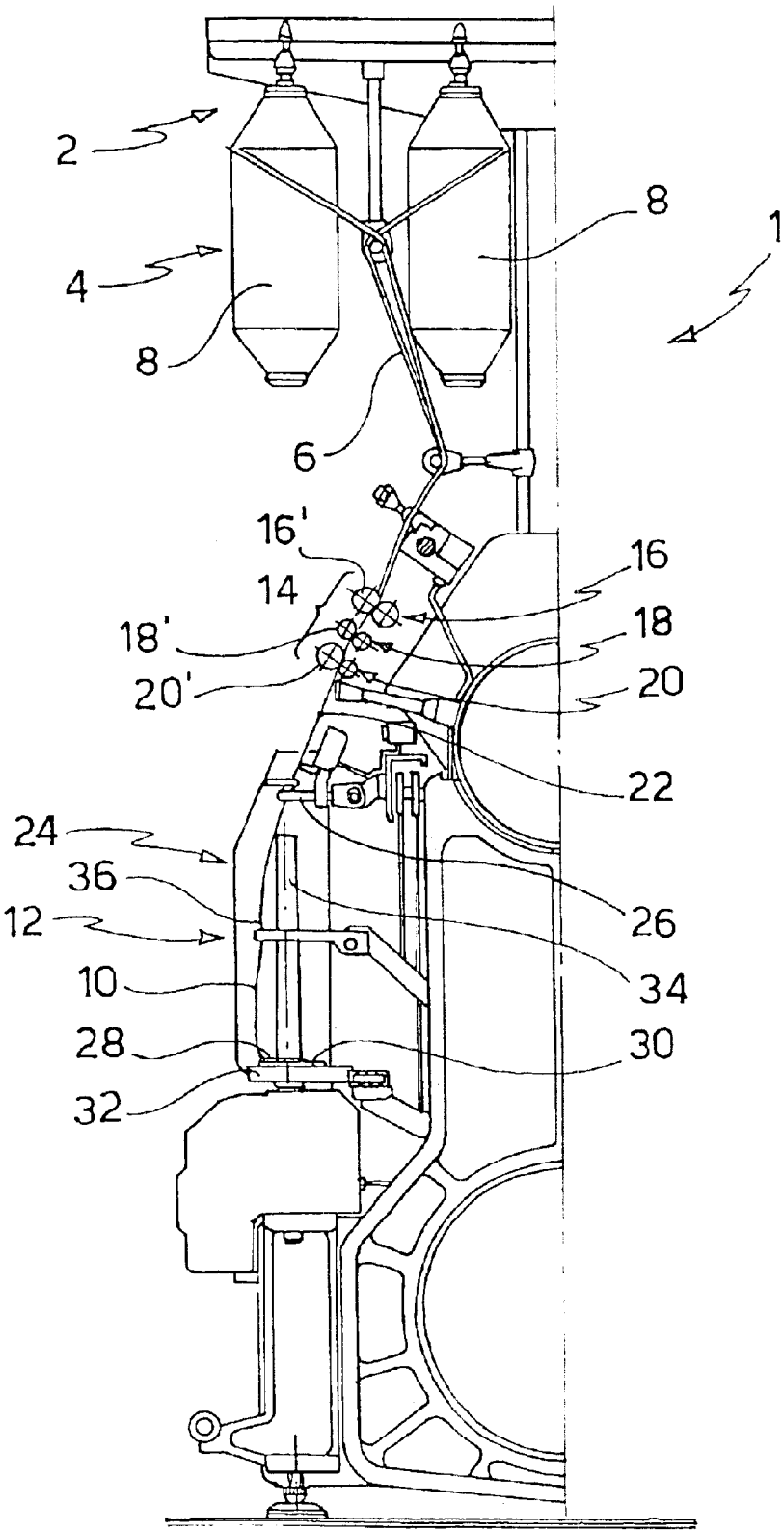
FIG. 1 is a schematic view of a spinning station of a ring spinning machine.

In the remainder of the present description, express reference will be made to a ring spinning machine as the textile machine which can be associated with the operating and control apparatus according to the invention.

With reference to the attached figures, the number 1 indicates the whole of a spinning station of a ring spinning machine.

In a preferred embodiment, the ring spinning machine comprises a plurality of spinning stations 1, arranged along a spinning frame.

Each spinning station 1 has, in a feed section 2, means 4 for feeding a roving 6 wound on bobbins 8 formed by preceding processes, such as processes carried out on a fly frame.

The end product of the process at each spinning station is a yarn wound on a bobbin placed in an output section 12 of the spinning station 1 of the textile machine.

In a spinning station, therefore, we can define a fibre processing flow which runs from the feed section 2 of the spinning station, located up-line, to the output section 12 of the said spinning station, located down-line with respect to the direction of the processing flow.

The roving 6 is initially inserted into a drawing device 14 comprising a plurality of drawing rollers coupled to idle rollers located above them.

In a preferred embodiment, the said drawing device 14 comprises, along the direction of the processing flow, a third drawing roller 16, a second drawing roller 18 and a first drawing roller 20. The said drawing rollers are coupled to idle rollers 16', 18' and 20' respectively.

In other words, the said first drawing roller 20 is located down-line from the second roller 18 and from the third roller 16, and therefore near the output section 12 of the spinning station 1.

The roving 6 leaves the drawing device 14 in the form of drawn yarn 22 and is inserted into a twisting and winding device 24, or, alternatively, into a condensation device located up-line from the twisting and winding device 24.

The twisting and winding device 24 comprises a fixed guide 26 and a slider 28 which is rotatable on a fixed ring 30, supported by a table 32. The said drawing device 14 also comprises a spindle 34, which also rotates, and a containing ring 36.

To carry out a drawing operation, the drawing rollers are moved at different peripheral speeds, increasing in the direction of the processing flow.

In other words, the peripheral speed of the third drawing roller 16 is less than, or not more than equal to, the peripheral speed of the second drawing roller 18 which, in turn, is less than, or not more than equal to, the peripheral speed of the first drawing roller 20.

Since the corresponding idle rollers coupled to the drawing rollers press the roving 6 on to the said drawing rollers, the said roving does not slide on the surfaces of the drawing rollers, but is drawn out.

The drawing results in an elongation of the roving and a decrease of its nominal diameter, in other words a proportional decrease in the count.

The drawn yarn 22 is wound on the spindle 34, causing the slider 28 to rotate around the said spindle and sliding over the fixed ring 30. The sliding of the drawn yarn 22 over the fixed ring 30 generates the twist of the yarn which is thus wound on the spindle in the form of twisted yarn.

At the same time, the table 32 is made to move with a vertical reciprocating motion, by which the twisted yarn is wound on the spindle to form the bobbin.

If the spindle rotates at a constant rotation speed of R r.p.m. and the drawing device releases S meters of drawn yarn, the twist T applied to one meter of twisted yarn is equal to R/S.

The apparatus for operating and controlling the textile machine comprises at least one driving means connected for operation to an operating shaft for processing the roving to produce the said yarn.

In a preferred embodiment, the said driving means can affect the speed of rotation of the said operating shaft, for example the speed of rotation of one of the said draw rollers for processing the said roving in order to produce the yarn.

In a preferred embodiment of the textile machine, the said driving means are common to a plurality of spinning stations, to which they are connected by suitable transmission means comprising belts, gear trains, chains and the like.

Figure 2:
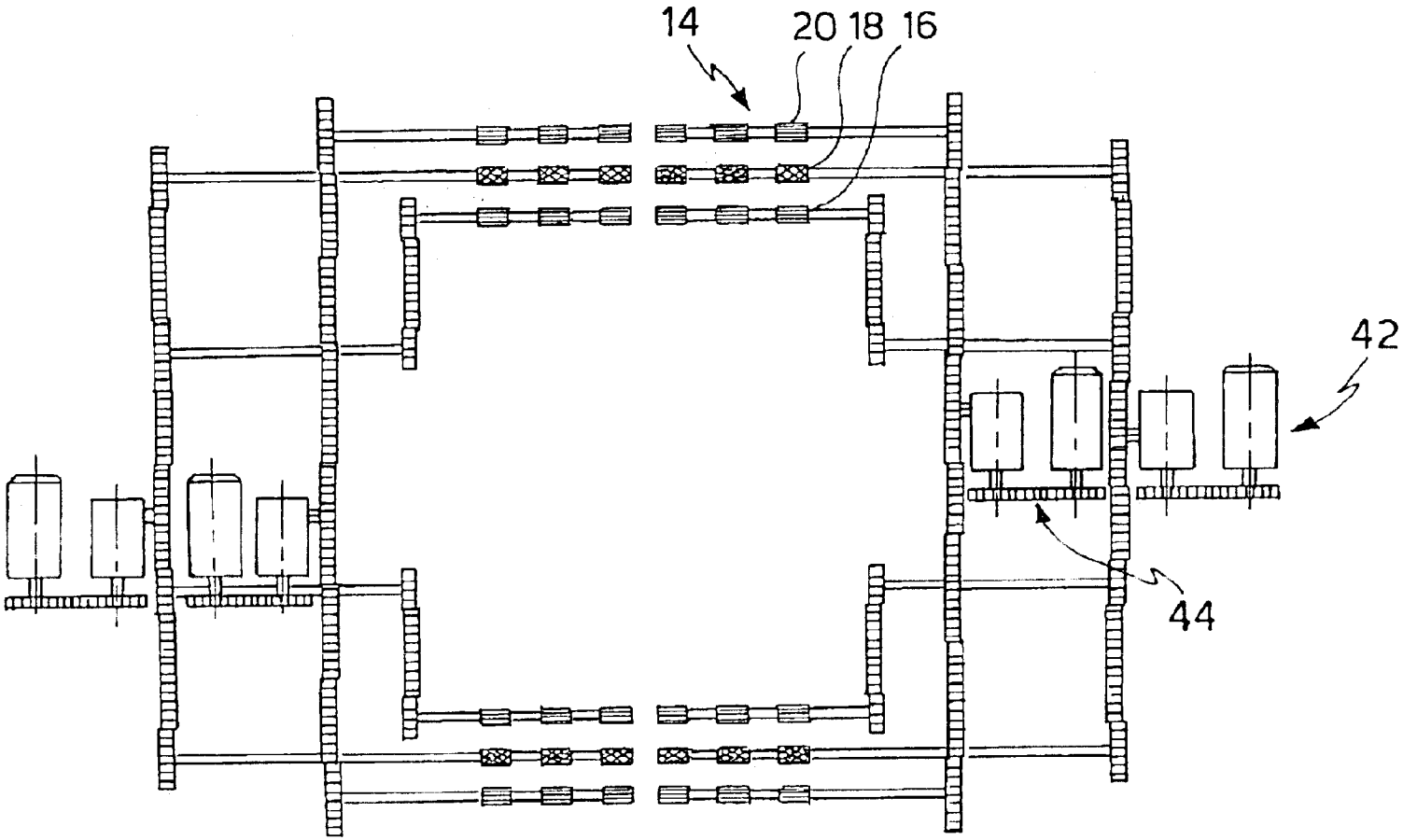
FIG. 2 is a schematic view of a drawing device of the spinning station of FIG. 1, connected to corresponding driving means.

In a preferred embodiment, the said textile machine has a spinning unit, comprising a plurality of spinning stations, each provided with the drawing device 14. Each drawing device has a connection to a first driving means 42 and to a second driving means 44 (FIG. 2).

The said first driving means 42 is connected for operation by the said transmission means to the second drawing roller 18 and to the third drawing roller 16 of the drawing device 14 of each spinning station.

The first driving means 42 is connected to the corresponding drawing rollers in such a way that the peripheral speed of the third drawing roller 16 is different from, and particularly lower than, the peripheral speed of the second drawing roller 18.

The second driving means 44 is connected for operation to the first drawing roller 20 by transmission means which provide a transmission ratio such that the peripheral speed of the first drawing roller 20 is made to be greater than, or at least equal to, the peripheral speed of the second drawing roller 18.

Figure 3:
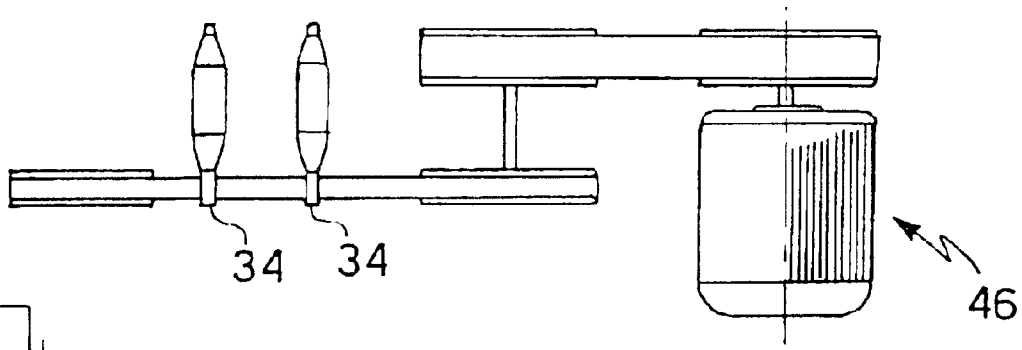
FIGS. 3 and 4 show a schematic view of a twisting and winding device of the spinning station of FIG. 1, connected to corresponding driving means.
Figure 4:
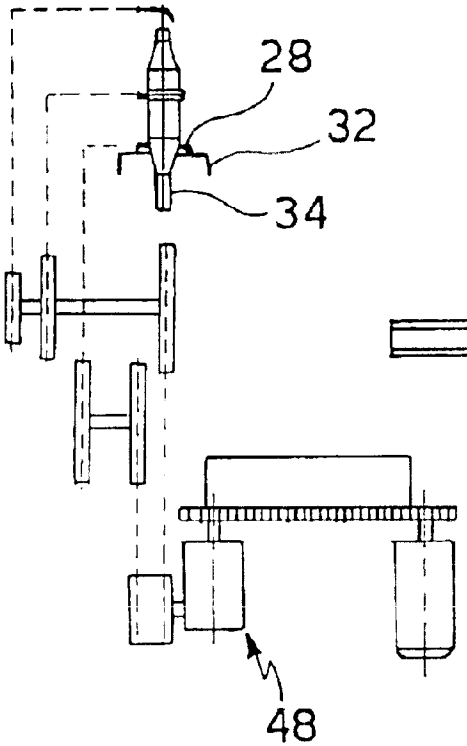

In a further embodiment, the spinning unit of the textile machine also has driving means for moving the twisting and winding device (FIGS. 3 and 4).

Preferably, the said twisting and winding device has a third driving means 46 connected for operation to the spindles 34 of the said twisting and winding device by transmission means.

In a further embodiment, the said device also has a fourth driving means 48 connected for operation to the table 32.

The operating and control apparatus according to the present invention also comprises at least one operating device, connected for operation to at least one driving means and capable of operating the said driving means according to reference signals.

Figure 5:
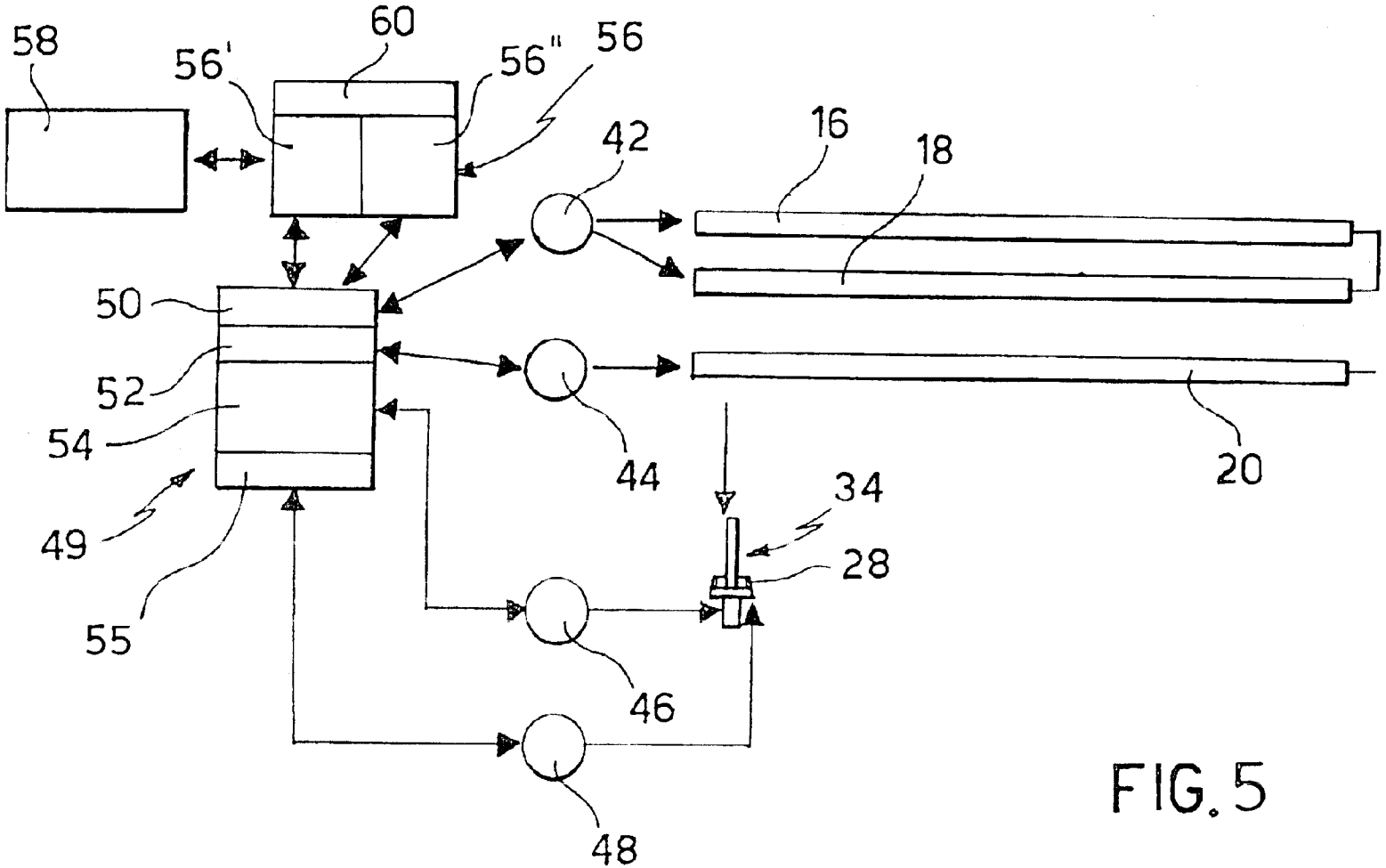
FIG. 5 is a diagram of an operating and control apparatus for the spinning station of FIG. 1.

Preferably, the said operating device can set a predetermined rotation speed for the driving means, and consequently for the corresponding operating shaft to which the driving means is connected, according to the said reference signals (FIG. 5).

In a preferred embodiment, the said apparatus comprises an operating device 49 which has a plurality of operating units, preferably a first operating unit 50, a second operating unit 52, a third operating unit 54 and a fourth operating unit 55.

Each operating unit is connected for operation to a driving means to set a predetermined rotation speed.

In particular, the first operating unit 50 is connected for operation to the first driving means 42 which has an effect on the speed of the third drawing roller 16 and of the second drawing roller 18. The second operating unit 52 is connected for operation to the second driving means 44 which has an effect on the speed of the first drawing roller 20. The third operating unit 54 is connected for operation to the third driving means 46 which has an effect on the rotation speed of the spindles 34. Finally, the fourth operating unit 55 is connected for operation to the fourth driving means 48 which has an effect on the traversing speed of the table 32.

The said operating and control apparatus also comprises at least one control device 56, connected for operation to the said operating device 49.

The control device 56 comprises first means for generating a reference signal 56' for keeping the said count and/or twist characteristics constant along the yarn.

In other words, the said first means for generating a reference signal 56' can receive, from operation sensors associated with the said operating shafts, values relating to the conditions of operation of the said shafts, and can generate corresponding reference signals for the operating device in order to produce a yarn consisting of a continuous sequence of portions in which each portion has a count and/or twist essentially equal to the count and/or twist of the following or preceding portion and equal to a predetermined value.

The control device also comprises second means for generating a reference signal 56" for producing count and/or twist characteristics which are variable along the yarn.

In other words, the said second means for generating a reference signal 56" can receive, from operation sensors associated with the said operating shafts, values relating to the conditions of operation of the said shafts, and can generate corresponding reference signals for the operating device in order to produce a yarn consisting of a continuous sequence of portions in which each portion has a count and/or twist equal to a predetermined value.

In a preferred embodiment, the textile machine has a single control device 56, for generating the said reference signals for a plurality of operating devices.

In further embodiments, the said textile machine has a plurality of control devices.

The said reference signals are generated by the control device 56 and are then sent to the operating device 49 on the basis of control commands which are input, manually for example, by operators acting on a panel 58 provided for the purpose and connected for operation to the said control device 56.

The said operating and control device also comprises selection means 60 connected for operation to the said control device, and capable of enabling or disabling the said first means for generating reference signals 56' and the said second means for generating reference signals 56".

In one embodiment, the said selection means enable only the first means for generating reference signals 56' in such a way that the said first means generate reference signals which are sent to the operating device 49 and which can keep the count and/or twist characteristics constant along the yarn.

In a further embodiment, the said selection means enable only the second means for generating reference signals 56" in such a way that the said second means generate reference signals which are sent to the operating device 49 and which can produce count and/or twist characteristics which are variable along the yarn.

Preferably, the said selection means 60 comprise means of loading corresponding software for controlling the said apparatus.

In a preferred embodiment, the said software loading means comprise a hardware key recognizable by the said selection means 60.

In other words, the said hardware key, inserted in or connected to the said selection means, is recognized by the said means which, according to the hardware key which is inserted, enable the said first means for generating reference signals or the said second means for generating reference signals.

In a variant embodiment, the said first means and the said second means for generating reference signals are included in a single means for generating a reference signal.

In other words, the said single means for generating reference signals supplies signals for producing count and/or twist characteristics along the yarn or variable characteristics along the yarn on the basis of the enabling of the selection means.

By way of example, the said single means for generating reference signals consists of a computer in which the said second means consist of a separate card which can be removed from the said computer and/or can be electrically and/or electronically disconnected from the said computer.

In one embodiment, the said second means for generating reference signals consist of a computer, for example a personal computer, or part thereof. On the other hand, the said first means for generating a reference signal are, for example, a separate signal generation device such as a PLC or an electrical or electronic circuit.

In one operating condition for the said operating and control apparatus, the said hardware key is not inserted.

In this operating condition, called the base operating condition, the enabling means 60 recognize the absence of the said hardware key and enable the said first means to generate reference signals 56' for the control device 56.

Thus, in the base operating condition, the reference signals sent by the control device 56 to the operating device 49 are such that a yarn having a uniform count and/or twist is formed.

Preferably, in the base operating condition, the rotation speeds imparted by the driving means to the operating shafts are essentially constant in the course of one process, so that the twisted yarn wound on a single bobbin has a count and twist which are essentially constant throughout the length of the said yarn.

In a further operating condition, a first hardware key is inserted or connected. The said hardware key is recognized by the enabling means 60 which enable the second means to generate reference signals 56".

In this operating condition, called the stubbing operating condition, the control device 56 detects the presence of the said first hardware key and loads a corresponding software program for the input and management of control commands for the execution of "slubbing" processes.

In particular, in one embodiment, for the purpose of executing the stubbing process, the called software makes it possible to input processing instructions comprising a slub value, in other words the length on the yarn of the slub to be formed, a pause value, in other words the length on the yarn to be interposed between one slub and the next, and a multiplier value, in other words the multiplication factor for the process count which generates a slub count.

The command instructions input in this way completely specify a stubbing process, since there will be a continuous sequence of portions along the length of the yarn, in which one portion will have a length equal to the slub value and a count equal to the slub count (namely the product of the nominal count and the multiplier), followed by a portion with a length equal to the pause value and a count equal to the nominal count.

The second means for generating reference signals 56" generate the said signals on the basis of the said command instructions. The said signals are sent to the operating device which operates corresponding operating shafts for the execution of the said process.

In particular, the first driving means 42 is operated, this means being connected for operation to the third drawing roller 18 and to the second drawing roller 16, enabling a "slubbing" process to be carried out. The said processes are executed with the twist of the yarn kept constant at a predetermined value.

In a further operating condition, a second hardware key is inserted or connected. The said hardware key is recognized by the enabling means 60 which enable the second means to generate reference signals 56".

In this operating condition, called the "multicount" operating condition, the control device 56 detects the presence of the said second hardware key and loads a corresponding software program for the input and management of control commands for the execution of "multicount" processes.

The said software makes it possible to input processing instructions comprising a slub value, in other words the length on the yarn of the slub to be formed, and a multiplier, in other words the multiplication factor for the count in the process which generates a slub count.

The command instructions input in this way completely specify a multicount process, since there will be a continuous sequence of portions along the length of the yarn, in which one portion will have a length equal to the slub value and a count equal to the slub count (namely the product of the nominal count and the multiplier).

The second means for generating reference signals 56" generate the said signals on the basis of the said command instructions. The said signals are sent to the operating device which operates corresponding operating shafts for the execution of the said process.

In particular, in the "multicount" operating condition, the speed of the first drawing roller 20 is essentially constant and the variation over time between the peripheral speed of the second drawing roller 18 and the first drawing roller 20 causes a variation of the count in each portion of the drawn yarn.

In a further operating condition, a third hardware key is inserted or connected. The said hardware key is recognized by the enabling means 60 which enable the second means to generate reference signals 56".

In this operating condition, called the "multitwist" operating condition, the control device 56 detects the presence of the said third hardware key and loads a corresponding software program for the input and management of control commands for the execution of "multitwist" processes.

In particular, in one embodiment, in order to execute the multitwist process, processing instructions are input, comprising a value of length, in other words the length on the yarn of the twisted portion to be formed, and a multiplier factor, in other words the multiplication factor for the nominal twist which generates a desired twist for the portion of yarn.

The command instructions input in this way completely specify a multitwist process, since there will be a continuous sequence of portions along the length of the yarn, in which one portion will have a length equal to the length value and a twist equal to the desired twist (namely the product of the nominal twist and the multiplier).

The second means for generating reference signals 56" generate the said signals on the basis of the said command instructions. The said signals are sent to the operating device which operates corresponding operating shafts for the execution of the said process.

In particular, in the "multitwist" operating condition, the variation of the speed of the first drawing roller 20, connected to the second driving means 44, enables the said process to be carried out.

In a further operating condition, a fourth hardware key is inserted, this condition being called the "multicount-multitwist" operating condition.

The control device 56 detects the presence of the said fourth hardware key and loads a corresponding software program for the input and management of control commands for the execution of "multicount-multitwist" processes.

In particular, in one embodiment, in order to execute the multicount-multitwist process, processing instructions are input, comprising a slub value, in other words the length on the yarn of the twisted portion to be formed, a multiplier factor, in other words the multiplication factor for the nominal count and for the nominal twist, which generates a desired count and a desired twist for a portion of yarn, and a value for a processing factor.

The command instructions input in this way completely specify a multicount-multitwist process, since there will be a continuous sequence of portions along the length of the yarn, in which one portion will have a length equal to the slub value and a count equal to the desired count (namely the product of the nominal count and the multiplier).

On the other hand, the processing factor is used to calculate the desired twist, according to the formula twist= factor*(nominal count)^0.7.

This is because the first driving means 42, connected for operation to the third and second drawing rollers, and the second driving means 44, connected for operation to the first drawing roller 20, enable a. "multicount-multitwist" process to be carried out by varying over time the rotation speeds imparted to the corresponding drawing rollers.

In a preferred embodiment the said command instructions are advantageously structured in command lines, each line comprising instructions which specify the length and thickness of each portion making up the yarn.

For example, in the slubbing operating condition, the command instructions are input in lines, each line comprising the slub value, pause value and multiplier factor.

In one embodiment, the execution of these command lines is cyclically sequential. In a further embodiment, the execution of these command lines is random.

Clearly, similar considerations and embodiments are provided for the organization of command instructions relating to the specification of multicount, multitwist or multicount-multitwist processes.

In a novel way, the operating and control apparatus according to the invention is applied simply and effectively either for the execution of slubbing, multicount, multitwist or multicount-multitwist processes or for the execution of conventional spinning processes.

This is because the said selection means can be used advantageously for enabling means for generating reference signals suitable for stubbing, multicount, multitwist or multicount-multitwist processes. Furthermore, in order to meet specific requirements, the said selection means make it possible to use the said textile machine as a conventional machine for executing processes with a constant count and twist.

Advantageously, therefore, in the case of standard production processes, with a constant count and twist, there is no need to employ specialist staff for programming the said machines, or to use working time for the programming of the said textile machines in order to execute a simple standard process.

At the same time, if there are specific requirements for the production of slub yarns or variable twist yarns, the said selection means can be used to enable the generation of reference signals for the execution of complex processes.

According to another advantageous aspect, the command instructions for the control device are divided into command lines, each designed to completely specify the length and thickness of the count and/or twist of each portion of the yarn to be produced, thus making the programming of the machine simple and rapid.

Clearly, a person skilled in the art will be able to produce numerous modifications and variations of the operating and control apparatus described above, in order to meet contingent and specific requirements.

In a further embodiment, the command instructions for the control device are input manually at the control panel, while, in yet another embodiment, the said command instructions are input by means of a magnetic medium (floppy disk), a digital medium (CD-ROM), or a perforated card, each of these being combined with the corresponding data reading system.

Clearly, all of these variants are to be considered as lying within the scope of protection of the invention as defined by the following claims.

What is claimed is:

1. Apparatus for operating and controlling a textile machine designed for processing a roving in order to form it into a yarn made from a continuous sequence of portions, each portion having predetermined count and/or twist characteristics, the apparatus comprising;

at least one driving means connected for operation to an operating shaft, the operating shaft being capable of carrying out processes on the roving designed to produce the yarn;

at least one operating device, connected for operation to the driving means, the operating means being capable of operating the driving means according to reference signals;

at least one control device connected for operation to the operating device;

wherein the control device comprises first means for generating a reference signal for keeping the count and/or twist characteristics constant along the yarn;

together with second means for generating a reference signal for producing count and/or twist characteristics which are variable along the yarn; and additionally, means for selecting the operation of the driving means, connected for operation to the control device, and capable of enabling or disabling the first means and the second means.

2. Apparatus for operating and controlling a textile machine according to claim 1, in which the first means and the second means for generating reference signals are included in a single means for generating reference signals.

3. Apparatus for operating and controlling a textile machine according to claim 2, in which the single means for generating reference signals comprises a computer.

4. Apparatus for operating and controlling a textile machine according to claim 3, in which the second means for generating reference signals comprise a card which is removable from the computer.

5. Apparatus for operating and controlling a textile machine according to claim 3, in which the second means for generating reference signals comprise a card which can be electrically and/or electronically disconnected from the computer.

6. Apparatus for operating and controlling a textile machine according to claim 1, in which the second means for generating reference signals comprise a computer.

7. Apparatus for operating and controlling a textile machine according to claim 1, in which the first means for generating reference signals comprise a separate signal generation device.

8. Apparatus for operating and controlling a textile machine according to claim 7, in which the separate device is a PLC.

9. Operating and control apparatus according to claim 1, in which the selection means comprise means of loading corresponding software.

10. Operating and control apparatus according to claim 9, in which the means of loading corresponding software comprise a hardware key.

11. Operating and control apparatus according to claim 9, in which a first software is used for inputting command instructions for executing a process to obtain a yarn having a constant count and/or twist.

12. Operating and control apparatus according to claim 9, in which a second software is used for inputting command instructions for executing a process to obtain a yarn having a count which is variable along the said yarn.

13. Operating and control apparatus according to claim 9, in which a third software is used for inputting command instructions for executing a process to obtain a yarn having a twist which is variable along the yarn.

14. Operating and control apparatus according to claim 9, in which a fourth software is used for inputting command instructions for executing a process to obtain a yarn having a count and twist which are variable along the yarn.

15. Operating and control apparatus according to claim 1, in which the textile machine is a ring spinning frame comprising a drawing device which has a plurality of drawing rollers, and in which the driving means comprise a first driving means connected for operation to a second and a third drawing roller and a second driving means connected for operation to a first drawing roller of the drawing device.

16. Operating and control apparatus according to claim 15, in which the first driving means is connected for operation to a second and a third drawing roller for the execution of a "slubbing" and/or "multicount" process.

17. Operating and control apparatus according to claim 15, in which the second driving means is connected for operation to a first drawing roller for the execution of a "multitwist" process.

18. Operating and control apparatus according to claim 15, in which the first driving means is connected for operation to a second and a third drawing roller and the second driving means is connected for operation to a first drawing roller for the execution of a "multicount-multitwist" process.

19. Method for processing a roving on a textile machine in order to form it into a yarn;

the yarn consisting of a continuous sequence of portions, each portion having a predetermined length and predetermined count and/or twist characteristics;

the method comprising the stages of:

selecting means for generating a reference signal for keeping the said count and/or twist characteristics constant along the yarn or means for generating a reference signal for producing count and/or twist characteristics which are variable along the yarn;

sending the reference signals to an operating device connected for operation to at least one driving means; and operating the driving means in accordance with the reference signals for the execution of the process on the yarn.

20. Method for processing a roving on a textile machine in order to form it into a yarn;

the yarn consisting of a continuous sequence of portions, each portion having a predetermined length and predetermined count and/or twist characteristics;

the method comprising the stages of:

inserting a hardware key into the textile machine and/or connecting it to the machine;

selecting means for generating a reference signal for keeping the count and/or twist characteristics constant along the yarn or means for generating a reference signal for producing count and/or twist characteristics which are variable along the yarn, in accordance with the hardware key;

sending the reference signals to an operating device connected for operation to at least one driving means; and operating the driving means in accordance with the reference signals for the execution of the process on the yarn.

21. Method for processing a roving on a textile machine in order to form it into a yarn;

the yarn consisting of a continuous sequence of portions, each portion having a predetermined length and predetermined count and/or twist characteristics;

the method comprising the stages of:

inserting a hardware key into the textile machine and/or connecting it to the machine;

selecting means for generating a reference signal for keeping the count and/or twist characteristics constant along the yarn or means for generating a reference signal for producing count and/or twist characteristics which are variable along the yarn, in accordance with the hardware key;

loading a control software in accordance with the hardware key;

inputting command instructions required by the control software;

generating reference signals in accordance with the command instructions;

sending the reference signals to an operating device connected for operation to at least one driving means; and operating the driving means in accordance with the reference signals for the execution of the process on the yarn.

* * * * *